United States Patent [19]

Devine

[11] 3,990,650

[45] Nov. 9, 1976

[54] BALANCED FRAME REEL TRAILER

[76] Inventor: Joseph C. Devine, R.D. No. 1, Box 206, Grantville, Pa. 17028

[22] Filed: Feb. 3, 1975

[21] Appl. No.: 546,821

[52] U.S. Cl. ..... 242/86.7; 214/DIG. 4; 214/501

[51] Int. Cl.[2] ..... B65H 75/40

[58] Field of Search ..... 242/86.5 R, 86.7, 99, 242/86.8; 214/DIG. 4, 130 C, 334, 501, 505; 254/166

[56] References Cited

UNITED STATES PATENTS

| | | | |
|---|---|---|---|
| 483,355 | 9/1892 | Johnson | 242/99 |
| 2,705,114 | 3/1955 | Worsham | 242/86.5 R |
| 3,000,588 | 9/1961 | Brady | 242/86.5 R |
| 3,073,574 | 1/1963 | Garnett | 242/86.5 R |

*Primary Examiner*—Stanley N. Gilreath
*Assistant Examiner*—John M. Jillions
*Attorney, Agent, or Firm*—Philip D. Freedman

[57] ABSTRACT

An easily loadable trailer for the transportation of reels comprises a cantilevered rail frame having an attached set of wheels and said frame being pivotally mounted across the axis of said wheels and further comprising at least two parallel upper rails having reel bar mounting means attached to said rails in opposed relationship for the receiving of reel bars and positioned on said frame on either side of the vertical plane through said set of wheels and said trailer further characterized as being tiltable first toward one end then toward the other to receive cable reels. The trailer also may be characterized by movable reel bar mounting means.

4 Claims, 8 Drawing Figures

BALANCED FRAME REEL TRAILER

As pointed out by Barnett, U.S. Pat. No. 3,379,392, wire rope, power transmission lines, telephone cables and like cables are often of a substantial length and are ordinarily wound upon flanged spool-like reels which may be quite large and heavy. When necessary to pay out cable, the reel is usually mounted and supported upon a horizontal shaft so it may rotate as the cable is pulled therefrom. For field use, a wheeled trailer may be adapted to carry and support a reel upon a shaft, so that the reel will not have to be taken off the trailer when the cable is to be paid from it.

Similarly, large reels are used for stringing the signal carrying and support cables in the cable television industry and various problems encountered in other industries are similarly encountered in this industry. In addition, there are various difficulties that arise related to the transportation and support of cable reels that are unique to the television cable industry. A suitable trailer for transportation and support of cable reels must be able to carry reels of varying diameters and weights and must be able to do so in a balanced relationship. Furthermore, the trailer because of certain governmental regulations must be of a restricted length and width. Finally, and most importantly, a suitable trailer must be easily loadable, preferably manually loadable.

The present invention is directed to a trailer structure for the carrying of cable reels providing for secure reel mounting while in transport on the trailer and being a relatively simple structure and yet being surprisingly effective for the handling of reels in transportation, in stringing, and particularly in loading.

J. Van Vorst, U.S. Pat. No. 1,895,217, is an early patent relating to a reel carrier having two longitudinally spaced upwardly projecting lugs setting on a wheeled wagon-type structure. Reel shafts may set on the top end of the projecting lugs. I. G. Stemm, et al, U.S. Pat. No. 2,635,827, relates to a reel sled for supporting a plurality of reels having a brake means to control the reel location. Haskell, et al, U.S. Pat. No. 2,703,218 is concerned with the prelashing of a cable through its supporting strand and is directed to a method and means which contemplates the feeding of the cable and the strand from suitable reels, lashing a wire around the cable as it is pulled up into position on the pole line, and applying suitable back tension to the cable and strand during the operation to assure the right amount of tension and sag in the completed run. The patent does show an apparatus characterized by a single chassis for the carrying of a single reel and having certain tension applying means. T. R. Hall, U.S. Pat. No. 2,780,419, similarly shows a single chassis frame for the carrying of a single reel having a hydraulic brake means and a hydraulic lift means. The necessity of having a hydraulic lift means emphasizes one advantage of the present invention and points out one of the problems existing in the cable reel art; that is, the problem of loading large and heavy reels onto simple structures of the type contemplated. The Hall patent solves the problem by providing a hydraulic lift mechanism. The present invention is particularly advantageous in that the subject trailer may be manually loaded as hereinafter described. Anrig, U.S. Pat. No. 2,867,390, shows a spool trailer having a carrier member for the spools and means operatively connected to the same for raising and lowering reels on the carrier members.

Fleischer, et al, U.S. Pat. No. 3,063,584 similarly shows a reel loading and unloading means. Garnett, U.S. Pat. No. 3,073,574, teaches a piece of equipment used for wire stringing that permits rope, as it is played out, to be moved back and forth parallel to the reel shaft to assure proper stringing of the line. It should be noted that many of the features shown in these described patents are incorporable into the present invention without changing the essential novel features of this invention. Garnett, U.S. Pat. No. 3,379,392, teaches a single yoke shaped main frame having a certain type of rocker beam pivotally connected at each side of the main frame to provide for the raising and lowering of the rearward end of the trailer. Parsen, U.S. Pat. No. 3,764,031, describes a trailer assembly that may be converted for carrying other types of mobile equipment.

The present invention relates to a trailer for the transportation of reels comprising a cantilevered rail frame having an attached set of wheels and said frame being pivotally mounted across the axis of said wheels and further comprising at least two parallel upper rails having reel bar mounting means attached to said rail in opposed relationship for the receiving of reel bars and positioned on said frame on either side of the vertical plane through said set of wheels and the trailer further characterized as being tiltable first toward one end then toward the other to receive cable reels.

Another aspect of the present invention is that the trailer reel bar mounting means may be movably attached along the upper rails parallel to the trailer's longitudinal axis so that reels of different weights may be loaded at opposite ends of the trailer at such proportionate distances from the pivotal mounting that the loaded reels are in a balanced relationship on the trailer frame. By proportionate distances is meant that the distance of the heavier loaded reel is lesser from the point of pivotal attachment than the distance of the lighter loaded reel from said point so that the trailer load weight is distributed across said point; that is, the center of gravity of the loaded trailer is directly above or near a point directly above the trailer axle.

The movable mounting means of this invention may comprise (A) a support member, (B) clamps for securing the mounting means to the upper trailer rails, the clamps attached to the support member, and (C) a double bar collar at the top of the support member and comprising a member inclined to said rails and having a collar and pin means at opposite ends of the inclined member for the receiving of reel bars.

The trailer of the present invention may also include a braking mechanism with each reel bar mounting means in combination with means for securing reels to the bars. The combination of this mechanism and the securing means makes it possible to control the speed at which cable is unraveled from mounted reels.

The foregoing described and additional features of the trailer of this invention will become apparent from the description which follows taken in connection with the accompanying drawings in which:

FIG. 3 is a top view of the trailer.

These figures show the present invention adapted to transport more than two reels.

Although the trailer of this invention is particularly designed for the cable television construction industry it is not so limited in its applications. The trailer of this invention may be used in any industry wherein spools or reels of lines, wires or cables are utilized.

The present invention provides a cable reel transporting device that may be utilized to carry spools or reels of unequal size and weight in such a manner that a stable and balanced load is maintained.

The present invention also achieves the object of providing a trailer that may be loaded entirely by hand requiring no more than two or three workmen and requiring no loading machinery or device.

In the cable reel industry, reels to be carried at the construction site may range in size from those of 20 inch diameters or 20 inch width is reels of 60 inch diameter and 30 inch widths. In this invention, provision for carrying reels of various sizes is made in the form of adjustable reel-holding devices. These devices may be detached from the trailer to provide room for the longer reels.

The devices permit positioning of reels of various sizes and weights on the trailer frame in a balanced condition. The positioning of the holding devices may facilitate loading of the trailer by providing pick up points on the frame that may be closer to the level of the bar of the reel to be loaded. By means of the device, the pick up points of the trailer may be adjusted according to the size of the reel to be loaded so that the trailer center of gravity remains over the trailer wheels or near a point over the wheels so that maximum leverage may be used in each loading situation. Loading procedure for the trailer of this invention will be described below.

Figure 1:
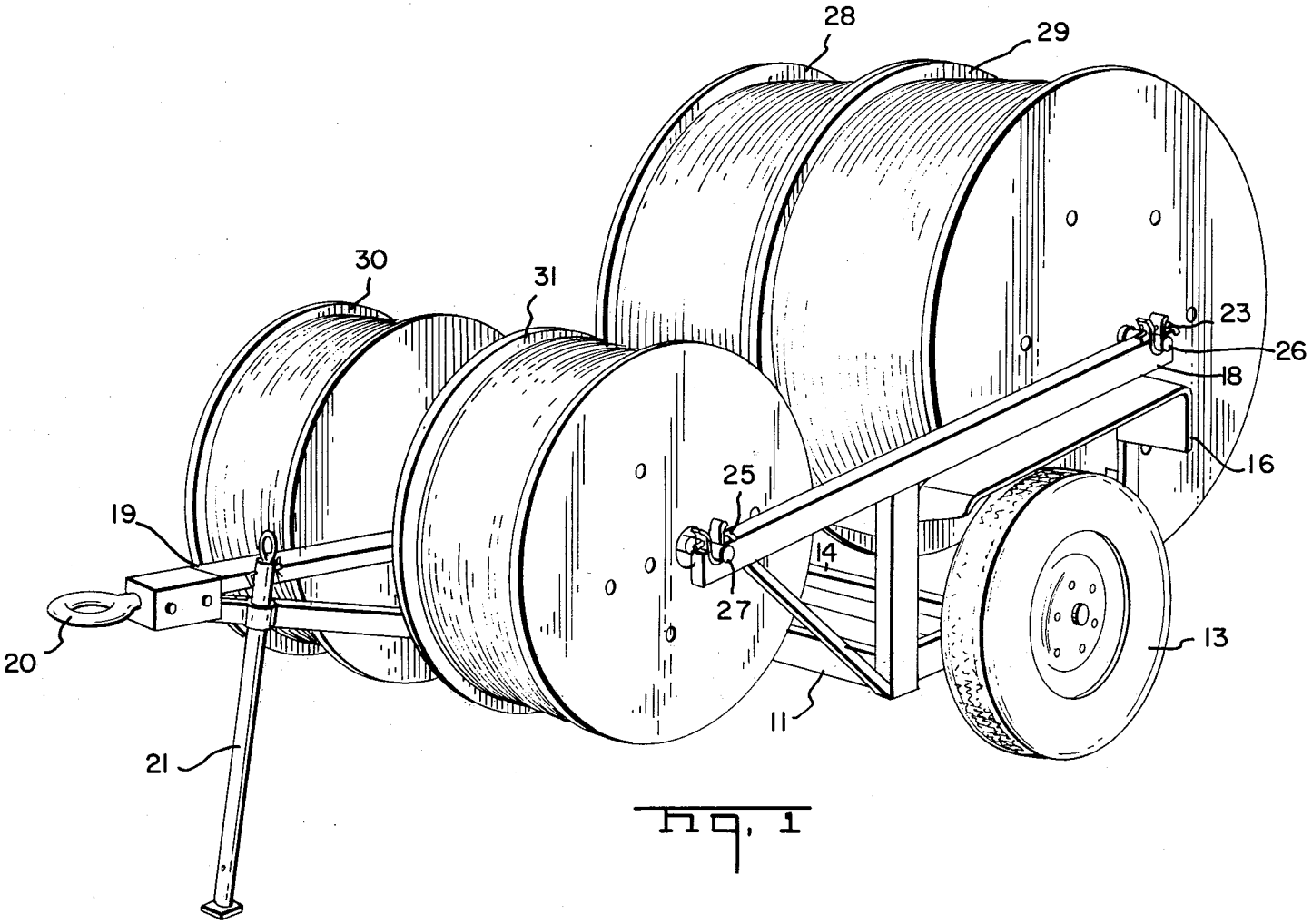
FIG. 1 is a perspective view of a balanced frame reel trailer structure illustrating the novel features of this invention. The Figure shows the trailer supporting two pairs of cable reels.
Figure 2:
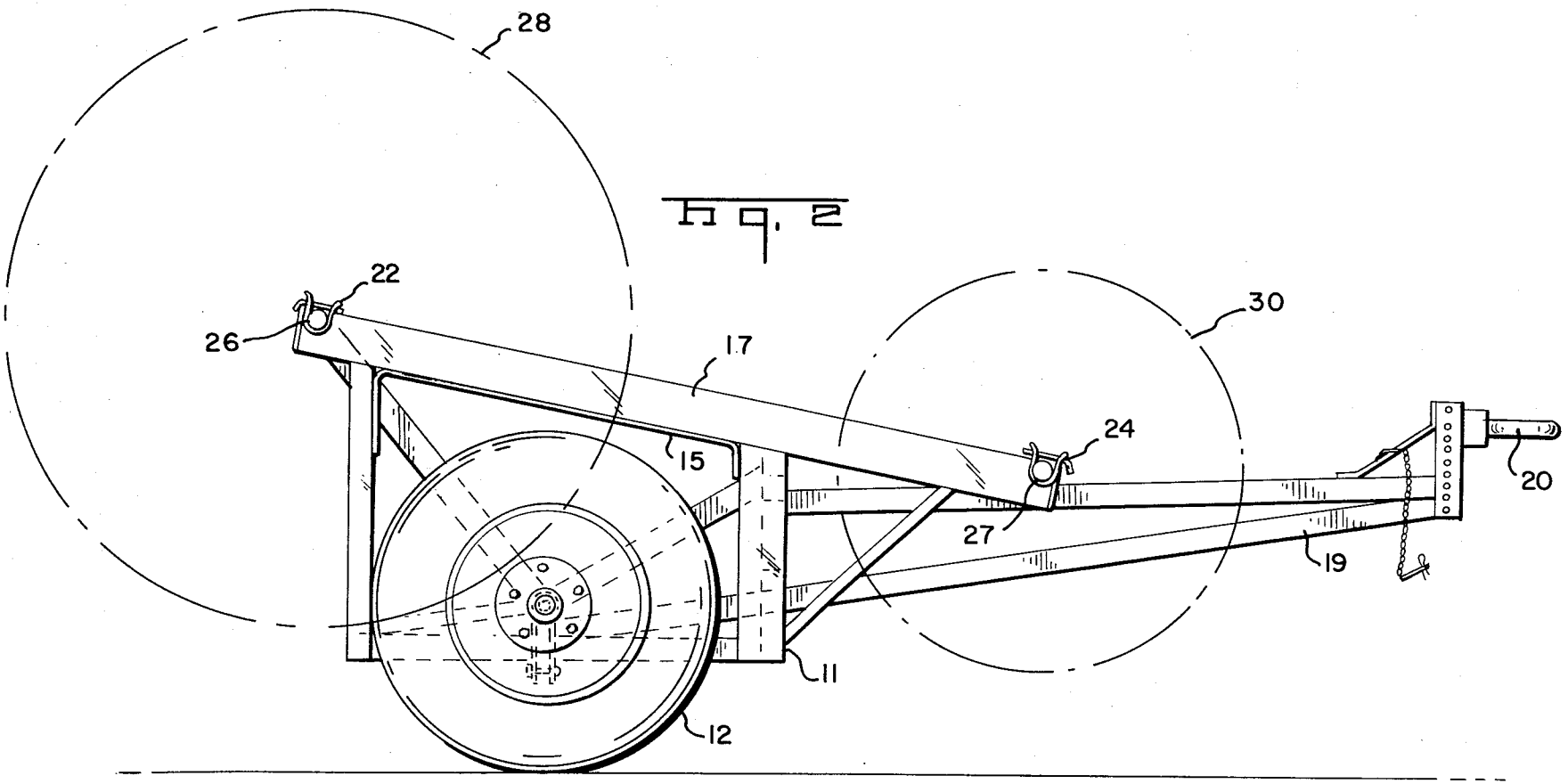
FIG. 2 is a side elevation of the trailer.

With reference to FIGS. 1, 2 and 3, the trailer as shown includes a frame 11 and a set of wheels 12 and 13 attached to a cross brace member 14 forming the axle for said wheels. The frame 11 may be pivoted around the axis formed by the cross brace member 14. The frame 11 comprises other bracing members as shown, but not numbered, wheel fenders 15 and 16 and a pair of top rails 17 and 18. A hitch brace structure 19 is attached to the frame 11 and includes a hitch 20 and a ground stand 21 (shown in FIG. 1). The trailer of this invention may be pulled by means of structure 19 and hitch 20 by a propelled vehicle or the trailer may be supported in a stationery position by means of stand 21.

Each top rail 17 and 18 of frame 11 is provided with a set of U-shaped reel bar mounting brackets at each end of the respective rail and indicated 22, 23, 24 and 25 in the drawings. These brackets are vertically disposed and are used for carrying bars 26 and 27 of mounted reels 28, 29, 30 and 31. Cable may be played out from these reels while the trailer is being pulled by a propelled vehicle or while the trailer is stationery.

Although not shown in the particular embodiment illustrated, the trailer of the present invention may be provided with springs to support the load of the reels.

Figure 4:
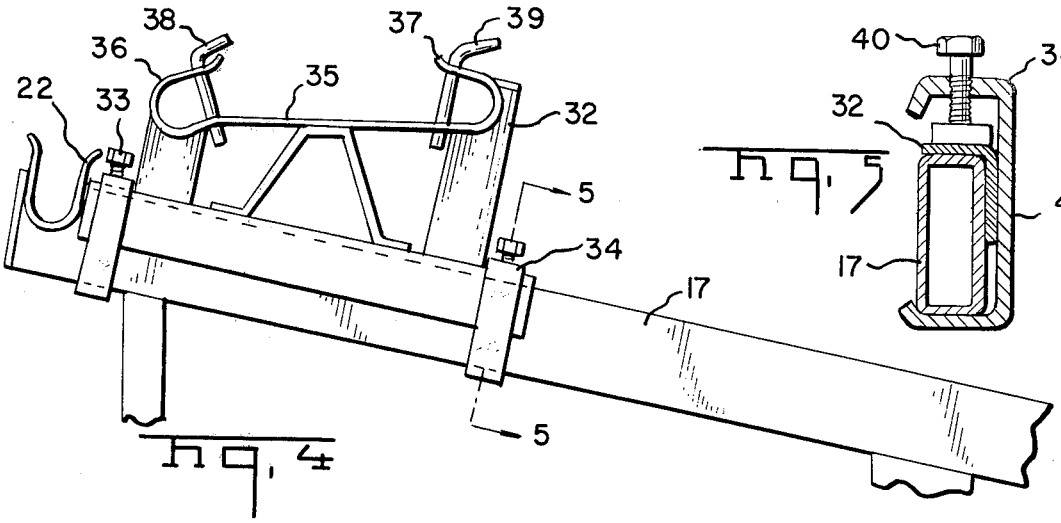
FIG. 4 is a side view of a slidable mounting bracket. This Figure illustrates one novel feature of the present invention not shown in FIGS. 1, 2 or 3.
Figure 5:
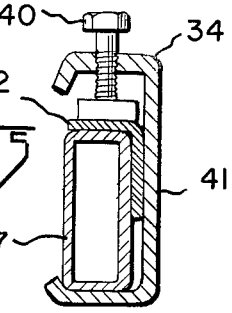
FIG. 5 is a sectional detail of a clamp taken along line 5—5 of FIG. 4.

FIGS. 4, 5, 6, 7 and 8 illustrate various novel features of the present invention. One distinct advantage of the present invention is that the trailer may carry cable reels of unequal size and weight in a balanced relationship. This balanced relationship permits the trailer to be more easily loaded, transported and otherwise handled than conventional trailers. FIG. 4 shows an adjustable reel-holding device easily detachable from the trailer for the loading of the larger reels. In FIGS. 4 and 5, the adjustable reel-holding device 32 is shown supported and attached to top rail 17. The reel-holding device 32 comprises support members, two clamps 33 and 34 for securing said device to rail 17 at various positions along said rail and a double bar collar 35. Opposing reel-holding devices may be located in any position along the two top rails and secured at those designated positions by means of clamps. It has surprisingly been found that the particular double bar collar shape of the reel-holding device provides maximum versatility in positioning in a balanced relationship, the reels of various weights and sizes known in the cable reel art. The double bar collars 36 and 37 and pins 38 and 39 provide numerous positions for the positioning of reels, along the top rail 17. Clamp 34 shown in detail in FIG. 5 comprises a tightening screw 40 and C-shaped member 41.

The adjustable reel-holding device 32 may be utilized for the transportation of one or one pair of reels only. In this application, the adjustable device positions the reels at a point above the trailer axle. When both front and rear spindles are carried, the bars of the rear reels 28 and 29 may be engaged in the adjustable device. The front reels 30 and 31 would then be loaded as described below and the adjustable device at the rear would be moved forward along rails 17 and 18 until the entire load would be balanced. The particular shape of the adjustable reel-holding device with its inclined double bar collar 35 permits carrying of large reels near to the trailer axle and clear of the ground. The adjustable device may also be utilized to rebalance the trailer as the reels lighten during payoff of cable.

Figure 7:
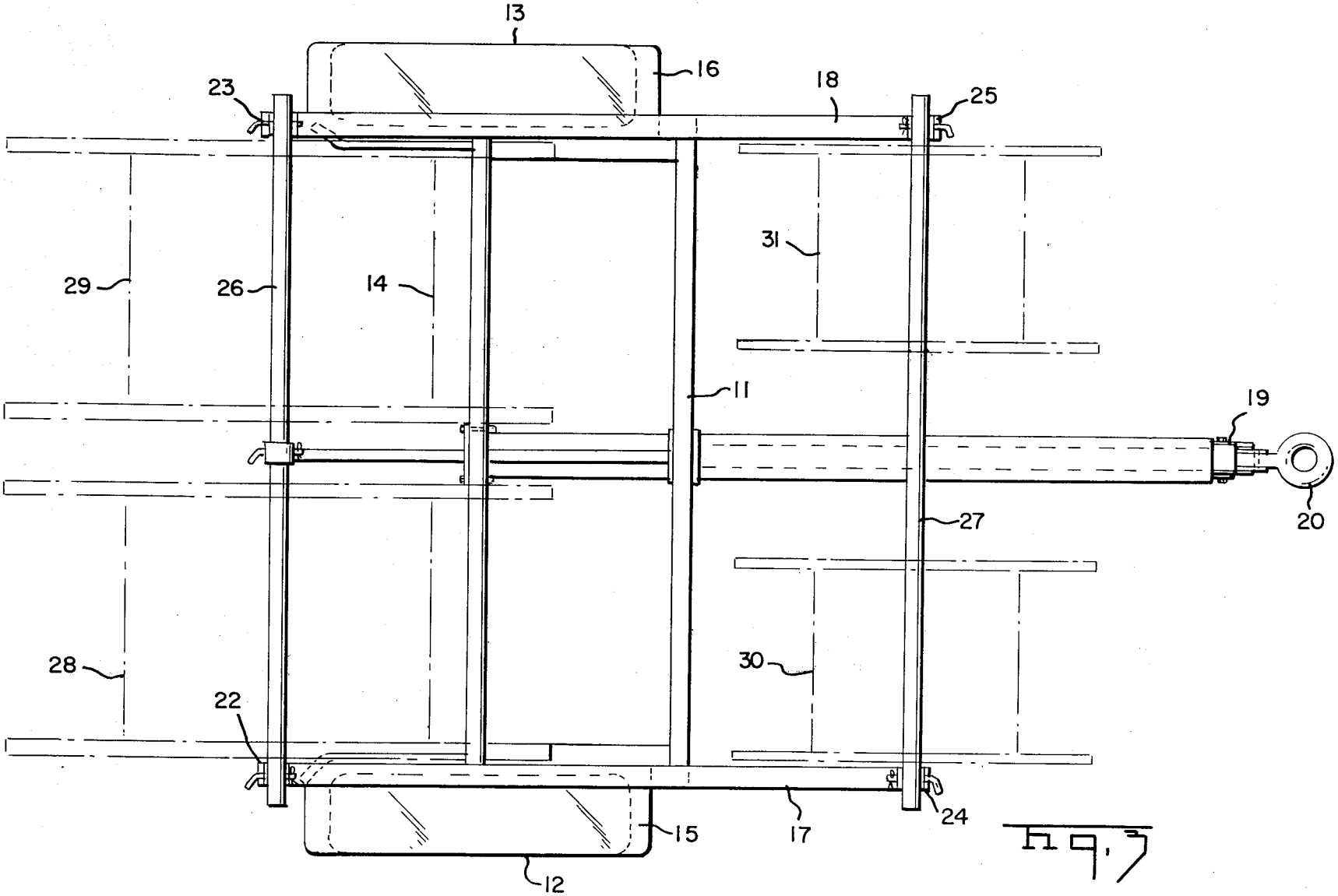
FIG. 7 is a sectional detail of the bar clamp on an enlarged scale, taken along line 7—7 of FIG. 6.
Figure 6:
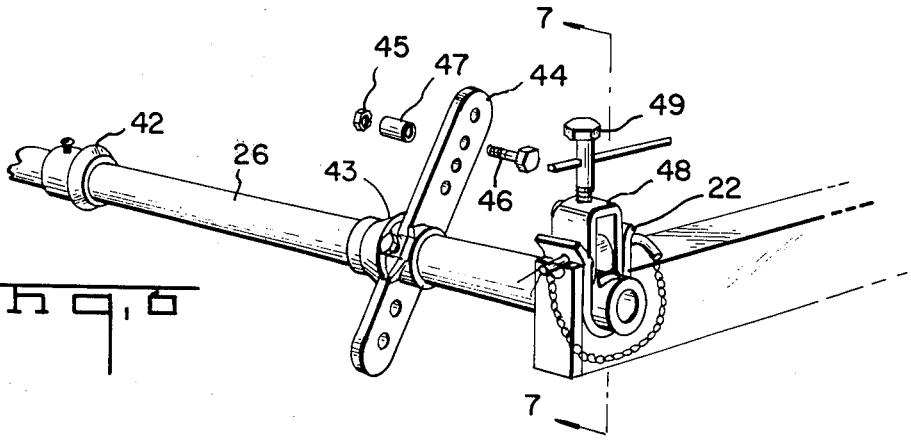
FIG. 6 is a perspective of a bar clamp, reel-securing means and slidable cone.
Figure 8:
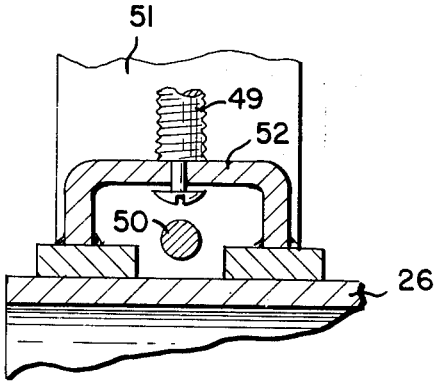
FIG. 8 is a sectional detail taken along line 8—8 of FIG. 7.
Figure 7:
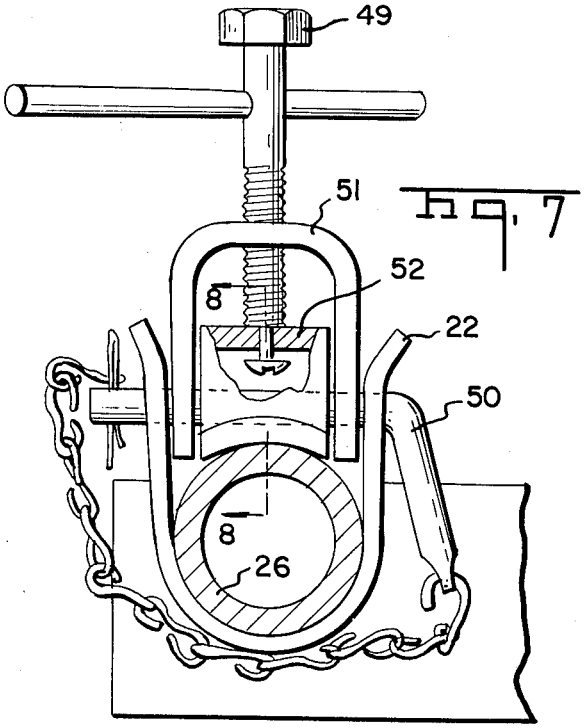

FIGS. 6, 7 and 8 illustrate another feature of the present invention whereby reels of various widths may be secured to bars at appropriate positions and further, whereby the reels may be held stationery when they are not playing-out cable. In these Figures, adjustable collar 42 and the collar 43 of drive plate 44 are conically shaped and may be positioned along reel bar 26 to fit against and to hold reel 28 at various positions along bar 26. Plate 44 is provided with various holes whereby reels having corresponding holes may be tightly secured to said bar and driven by means of nut, bolt and drivepin 45, 46 and 47 respectively.

Adjustable brake 48 will fit bars of varying diameters and comprises turn screw 49, securing pin 50, trunion 51 and brake shoe 52. The brake sets into the U-shaped reel bar mounting brackets 22, 23, 24 and 25 and may be used to secure reel bars. Securing pin 50 fits through the mounting bracket and trunion as shown. The brakes may be adjusted to provide a desired amount of drag as the reels turn to play-out cable.

Many modifications of the trailer 11 may be made without departing from the scope of the present invention. Thus, for example, a mounting bracket may be positioned on an extension from the underside of the trailer cross brace member 14 for the carrying of small diameter reels of a great gross weight of 600 pounds or better.

In loading the trailers of the present invention, the reels 28, 29, 30 and 31 to be loaded are first placed on the ground in front and to the rear of the trailer with the larger reels 28 and 29 to the rear in all instances. A reel bar 26 is inserted through the larger reel or reels and positioned so that its ends protrude an equal distance on either side of the reel or reels. The trailer is then tipped back by raising the trailer tongue 19 by hand until the U-shaped rail bar mountng brackets 22 and 23 at the rear of the top frame rails 17 and 18 are under the bar 26 to be raised. The tongue 19 is then lowered until the brackets 22 and 23 engage the bar 26 in an upward movement. Lock pins are inserted through the brackets to secure the bar.

The tongue 19 is then forced downwardly to the ground raising the reels 28 and 29. A bar is placed through the frontward reel or reels 30 and 31 and they are rolled to the trailer and positioned so that the bar 27 fits into the front brackets 24 and 25. The tongue 19 is then raised so that the brackets 24 and 25 engage the bar 27 and so that pins may be fitted through the brackets to secure the bar.

What is claimed is:

1. A trailer for the transportation of reels comprising a cantilevered rail frame having an attached set of wheels, said frame being pivotally mounted across the axis of said wheels and further comprising lower rails and at least two parallel upper rails inclined with respect to said lower rails downwardly toward the front of said trailer, said upper rails being longer than said lower rails and extending forward beyond said lower rails and having reel bar mounting means attached to said upper rails in opposed relationship for the receiving of reel bars and positioned on said frame on either side of the vertical plane through said set of wheels at distances from said vertical plane in inverse proportion to the weight of the reels to be transported; a single rail tongue attached to said rail frame and comprising a member extending forward from the center of said axis of said wheels to define spaces on either side of said tongue between the forward extensions of said upper rails, said tongue and said rail frame further characterized as being tiltable first toward the back of said trailer and then toward the front to receive cable reels onto said upper rails in said spaces on either side of said tongue.

2. The trailer of claim 1 further including means for removably positioning said reel bar mounting means along the upper rails parallel to the trailer's longitudinal axis so that reels of differing weights may be loaded at opposite ends of said trailer at such proportionate distances from the pivotal mounting so that said reels are in balanced relationship on said trailer frame.

3. The trailer of claim 2 wherein each of said reel bar mounting means comprises a support member and a double collar attached to said support member, said double collar comprising a member inclined to said rails, and collar and pin means at opposite ends of said inclined member for the receiving of reel bars, and wherein said positioning means comprises clamps for removably securing each said support member to said upper rails.

4. The trailer of claim 2 further including reel bars for supporting said reels and wherein said frame further comprises a braking mechanism at said reel bar mounting means and means attached to each said reel bar for securing reels to said bars, the combination of said mechanism and said securing means being for the controlling of the speed at which cable may be unraveled from mounted reels.

* * * * *